United States Patent [19]

VerMehren

[11] 4,126,948

[45] Nov. 28, 1978

[54] ENVELOPE DRYING MACHINE

[75] Inventor: Hubert R. VerMehren, Florissant, Mo.

[73] Assignee: Ga-Vehren Engineering Company, St. Louis, Mo.

[21] Appl. No.: 600,933

[22] Filed: Jul. 31, 1975

[51] Int. Cl.[2] ..... F26B 15/08

[52] U.S. Cl. ..... 34/150; 34/187; 93/74; 271/187

[58] Field of Search ..... 93/74, 75, 62, 61 R; 271/80, 187, 2; 34/187, 109, 149, 150, 151, 163, 70, 71, 114, 122; 198/103, 133, 134

[56] References Cited

U.S. PATENT DOCUMENTS

| | | | |
|---|---|---|---|
| 212,634 | 2/1879 | Swift | 93/74 |
| 1,426,095 | 8/1922 | Parker | 34/114 |
| 1,830,287 | 11/1931 | Öhlin | 34/122 |
| 2,140,112 | 12/1938 | Novick | 93/62 X |
| 2,709,951 | 6/1955 | Skow | 93/62 |
| 3,162,438 | 12/1964 | Perry, Jr. | 271/187 |
| 3,409,290 | 11/1968 | Bergland | 271/187 X |
| 3,537,362 | 11/1970 | Harper | 93/62 |
| 3,847,384 | 11/1974 | Bethke | 271/2 |

FOREIGN PATENT DOCUMENTS

| | | | |
|---|---|---|---|
| 360,431 | 11/1931 | United Kingdom | 93/74 |

*Primary Examiner*—William F. O'Dea
*Assistant Examiner*—Harold Joyce
*Attorney, Agent, or Firm*—Cohn, Powell & Hind

[57] ABSTRACT

This apparatus is used for drying the gummed flaps of envelopes and includes a drying wheel that rotates within an embracing plenum chamber from which hot air is directed across envelopes carried by the wheel. The wheel includes spaced discs having slots into which the envelopes are guided and held during the drying process, and from which the envelopes are discharged following drying. The slots are of a configuration to apply pressure to the envelopes and thereby ensure that they are retained within the slots against the action of centrifugal forces.

2 Claims, 8 Drawing Figures

ENVELOPE DRYING MACHINE

BACKGROUND OF THE INVENTION

This invention relates to envelope drying machines, and more particularly to an improved drying wheel apparatus for effectively drying the envelope closure flaps to prevent adjacent envelopes from adhering together when stacked.

Drying apparatus has been employed in conjunction with envelope machines for many years. Such apparatus in its most prevalent form utilizes a belt or chain conveyor on which the envelopes are carried and the gum dried, before the envelopes are transferred to stacking and counting apparatus. This type of drying apparatus is generally satisfactory where the adhesive used is of a rapid drying type. However, for gum adhesives, particularly those of the pressure sensitive variety which dry relatively slowly, a smaller, more compact means having improved provisions for accelerating the drying process is desirable for use with high capacity envelope machines.

This requirement has led to the development of conveyor wheels rather than belts to carry the envelopes during the drying process. However, there have been two problems associated with this type of device. One is the provision of an efficient drying means and the tendency has been to blow drying air outwardly from a central manifold but this has not proven satisfactory. Another problem is the suitable holding of the envelopes, during the drying process, against the tendency for them to move outwardly under centrifugal forces when the drying wheel is rotating at relatively high speed.

The present apparatus solves these and other problems in a manner not disclosed in the known prior art.

SUMMARY OF THE INVENTION

The principal object of the invention is to provide a compact, space-conserving drying wheel assembly suitable for use with high speed envelope machines and having a superior envelope drying and retaining means.

It is an important object to provide a drying wheel assembly having an exterior plenum chamber disposed thereabout for directing drying air inwardly into the envelopes carried by the wheel assembly.

Another important object is to provide a drying wheel assembly which includes a plurality of spaced discs having arcuate slots open at the disc periphery to receive the envelopes, the slots having a configuration to ensure that the envelopes are securely retained against outward movement under the action of centrifugal forces.

It is an object to provide a guide assembly which ensures that the envelopes maintain arcuate alignment when turned from the horizontal plane to the vertical plane for reception into the slots.

Another object is to provide a drying wheel which accommodates envelopes of different size in positions best adapted for optimum drying conditions.

It is an object of this invention to provide a drying apparatus which is relatively inexpensive to manufacture, extremely efficient, and yet relatively simple to operate.

DESCRIPTION OF THE PREFERRED EMBODIMENT

Figures 1, 2:
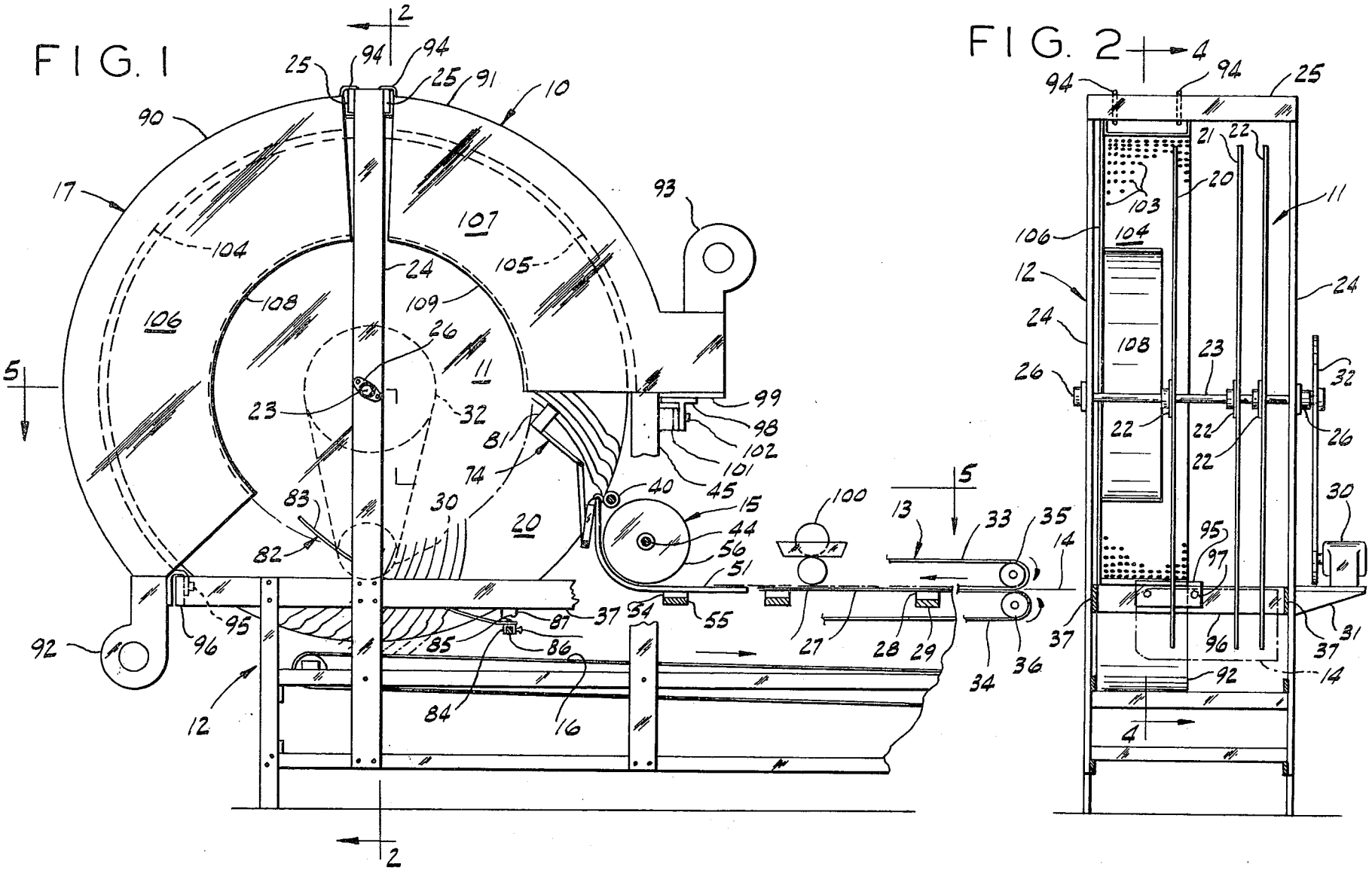
FIG. 1 is a side elevational view of the drying apparatus.
FIG. 2 is a cross sectional view taken on line 2—2 of FIG. 1.

Referring now by characters of reference to the drawings and first to FIG. 1 it will be understood that the drying apparatus, which is generally indicated by numeral 10, inludes a slotted wheel assembly 11 rotatively mounted to a frame 12. The frame 12 constitutes a support means for the wheel assembly 11 and also provides support for a double belt conveyor 13 which is located at the far side of the frame 12, (FIGS. 3 and 5) and which delivers envelopes 14 to the wheel assembly at a predetermined rate and at predetermined intervals. The flaps of the envelopes 14 are coated with gum en route to the wheel assembly 11 at a gumming station indicated by numeral 100. Following the gumming operation a guide assembly, generally indicated by numeral 15, cooperates with the belt conveyor 13 to turn the envelopes 14 from a horizontal direction to a vertical direction preparatory to feeding said envelopes into said wheel assembly. Envelopes are fed continuously into the wheel assembly 11 and are transported through about 270 degrees before being discharged onto a return conveyor 16. During rotation with the wheel assembly 11, the envelopes 14 are subjected to inwardly directed streams of heated air emanating from a plenum chamber assembly 17, which is also carried by the support frame 12 and constitutes a drying means. The various components of the envelope drying apparatus 10 will now be described in more specific detail.

As shown in FIG. 2 the wheel assembly 11 includes a plurality of substantially identical discs, three in number in the preferred embodiment and indicated by numerals 20, 21 and 22. Each disc is provided with a mounting boss 22 by which it is fixedly attached to a drive shaft 23 and said discs are selectively adjusted lengthwise of the shaft 23 to suit different sizes of envelopes. The shaft 23 is rotatively mounted between a pair of vertical frame members 24, which are interconnected at their upper end by a cross member 25, each of said vertical members 24 being provided with a journal bearing 26. The shaft 23 is rotated by a drive means consisting essentially of a motor 30 mounted to a bracket 31, the motor being chain-connected to a sprocket 32 fixedly attached to the end of the shaft 23.

Figure 3:
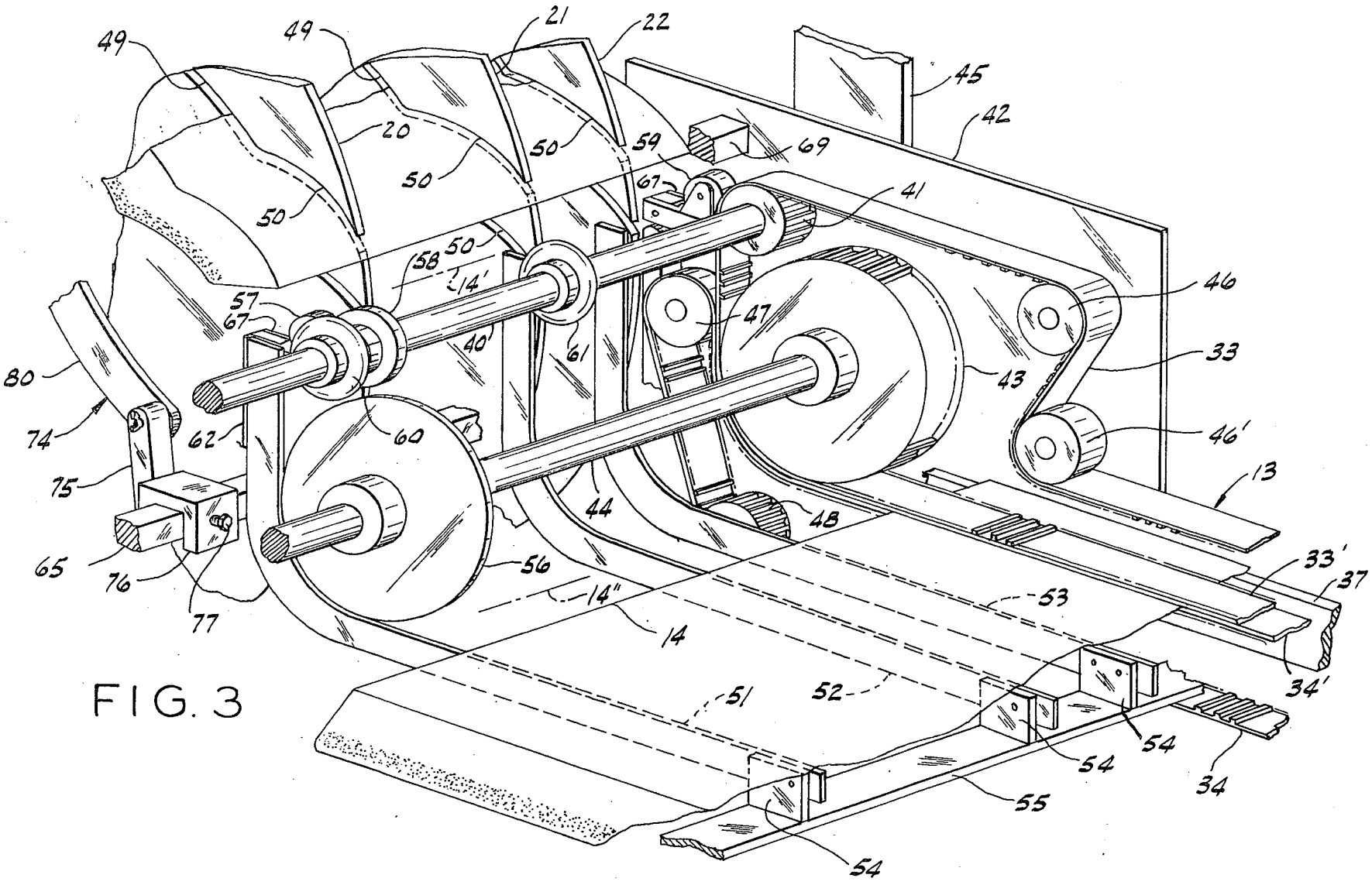
FIG. 3 is an enlarged fragmentary view in perspective of the guide assembly.
Figure 5:
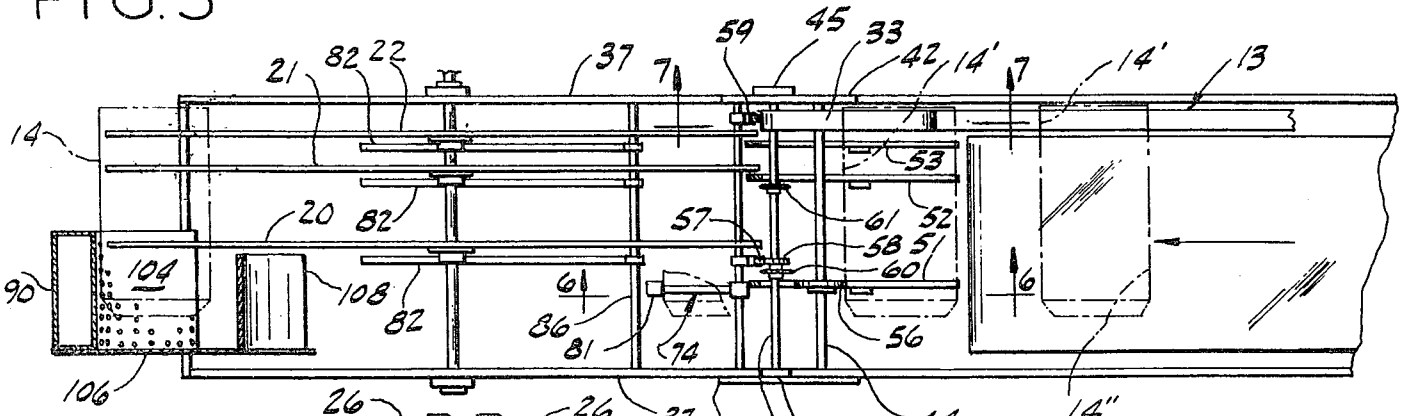
FIG. 5 is a sectional plan view taken on line 5—5 of FIG. 1.

The delivery conveyor 13, which supplies envelopes 14 to the guide assembly 15, is best understood by reference to FIGS. 1, 3 and 5. As shown in FIG. 1, the conveyor 13 includes upper and lower endless belts 33 and 34 which travel around end rollers 34 and 35 respectively, mounted to the frame 12. The envelopes 14 are received between adjacent spans of the upper and lower belts 33 and 34. These adjacent spans, which are indicated in FIG. 3 by numerals 33' and 34', grip the rear, closed end of the envelopes 14 and transport them toward the guide assembly 15. It will be understood that the frame 12 includes horizontal support means for the envelopes 14 as they are transported toward the guide assembly, such as a flat member 27, which is carried by brackets 28 supported on cross members 29 (FIG. 1) and that the flaps of the envelopes 14 are gummed on their upper side prior to delivery to the guide assembly 15.

Figure 7:
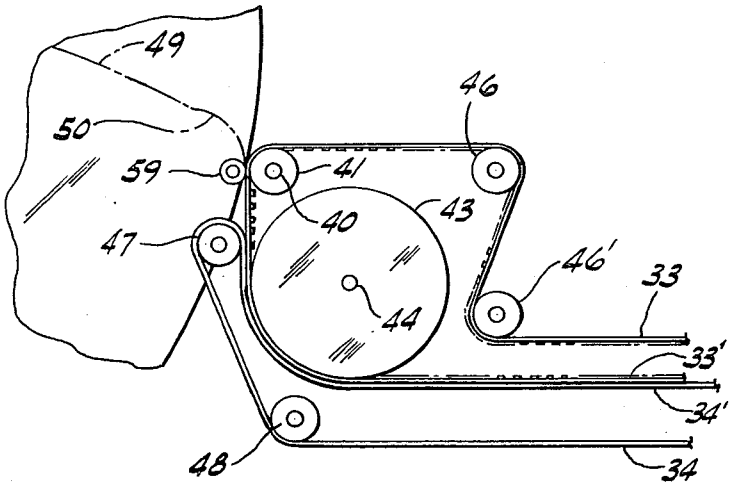
FIG. 7 is an enlarged, fragmentary cross sectional view, partly schematic, taken on line 7—7 of FIG. 5.

As shown by reference to FIG. 3 read in conjunction with the schematic arrangement of FIG. 7, the upper conveyor belt 33 is driven by a drive wheel 41 which is mounted to a drive shaft 40. The shaft 40 is journal mounted between opposed brackets 42 attached to upper longitudinal frame members 37 and is driven through the medium of a gear train (not shown) by the same motor 30 which drives the wheel assembly 11. Importantly, the adjacent spans 33' and 34' of belts 33 and 34, are both rotated through 90° to turn the envelopes 14 from a horizontal to a vertical direction, by means of a relatively large diameter idler wheel 43, mounted on a shaft 44 which is also journal mounted between brackets 42. The upper belt 33 return is facilitated by means of intermediate idler wheels 46 and 46'. The lower belt return is accomplished by means of an end wheel 47 and an intermediate idler wheel 48. It will be understood that wheels 45–48 are rotatively mounted to bracket 42 by means of associated stub shafts and that belts 33 and 34, the drive wheel 41, and the large idler wheel 43 are provided with interengaging lands and grooves to ensure that the linear speed of the conveyor belt is synchronized with the rotational speed of the wheel assembly 11.

Essentially, the guide assembly 15 provides a means of delivering envelopes 14 into slots 49 which are provided at equal intervals around the circumference of the discs 20, 21 and 22 and are laterally aligned to receive said envelopes 14. For purposes of clarity, FIG. 3 illustrates one envelope 14 on the horizontal approach to the transition position from horizontal to vertical and one envelope already received within the slotted discs. The disposition of the leading and trailing edges respectively of an intermediately disposed envelope about to enter the slots 49 is indicated by numerals 14' and 14'' in FIG. 3 and is best understood by reference to FIG. 6. The disposition of parts of the guide assembly 15 will now be specifically described with particular reference to FIGS. 3, 5 and 6.

Importantly, the guide assembly 15 includes a plurality of substantially ell-shaped guide fingers 51, 52 and 53 which are mounted to the frame 12 as by bracket elements 54 attached to a transverse frame member such as that indicated by numeral 55. The upper surfaces of the fingers 51, 52 and 53 are substantially aligned with the upper surface of the lower conveyor belt span 34' and in order to provide the necessary curvature for the envelopes 14 to make the transition from a horizontal to a vertical position means are provided which urge the envelope to follow the contour of the guide fingers. In the preferred embodiment, the means is provided by the idler wheel 43 and by a guide wheel 56, which is fixedly mounted to shaft 44 in spaced relation from the wheel 43, and is of a radius substantially equal to the radius of wheel 43, allowance being made for the thickness of the belt 33.

Figures 6, 8:
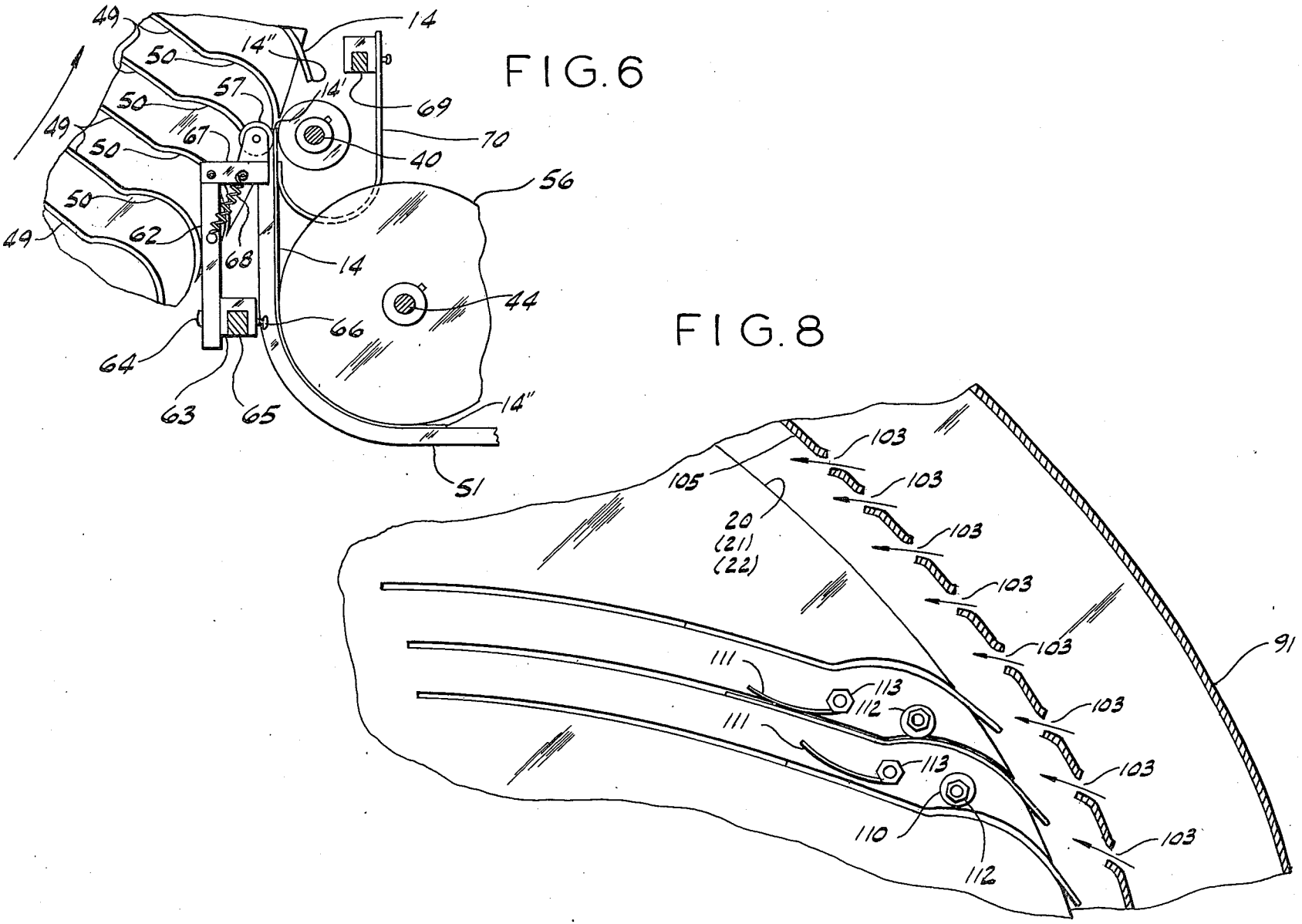
FIG. 6 is an enlarged, fragmentary cross sectional view taken on line 6—6 of FIG. 5.
FIG. 8 is an enlarged detail illustrating the envelope receiving slot configuration and the configuration of the plenum chamber discharge apertures.

When the envelopes 14 carried by belt spans 33' and 34' are transported around the wheel 43 and reach the upper portion of the fingers 51, 52 and 53, they are frictionally engaged at the flap end and the rear end by friction means spaced lengthwise of the drive shaft 40. In the preferred embodiment, the friction means are provided at the flap end of the envelope 14 by cooperation between a friction wheel 57, which is disposed in pressure engagement against an aligned drive wheel 58 mounted on the drive shaft 40, and at the other end by a similar friction wheel 59, which is disposed in pressure engagement against the belt 33 as it passes around drive wheel 41. As shown in FIG. 6 the point of engagement between the wheels 58 and 59 and the envelope 14 is substantially aligned with the entrance to the slots 49 as they rotate by this point. In order to facilitate delivery of the envelope 14 into said slots a pressure wheel 60, having a diameter slightly greater than wheel 58, is adjustably mounted to said guide shaft 40 adjacent said wheel 58. A similar wheel 61 is mounted to the shaft 40 intermediate the friction wheels 58 and 59 and said wheels 60 and 61 preclude any tendency for the envelopes to move out of engagement with the fingers.

Friction wheels 57 and 59 are held in place by substantially identical supports which, as shown in FIG. 6, include a post member 62 which is slotted at its lower end for adjustable connection to a saddle 63 as by screw 64. The saddle 63 is slidably mounted on a cross member 65, which is attached to the frame 12 at its ends, and said saddle is provided with clamping screws 66 to facilitate positioning of said saddle lengthwise of said cross member. The friction wheel 57 is carried at the end of an arm 68, which is pivotally attached to the post member 62 and urged into engagement with the envelope 14 as by spring element 69.

A similar cross member 69 disposed above cross member 65 provides a means of positioning an auxiliary guide member, such as the hook guide 70 indicated in FIG. 6, when such a member is necessary to ensure that large envelopes maintain a vertical disposition.

In order to gauge the extent to which the envelopes 14 are received within the slots 50 of the discs 20, 21 and 22, an adjustable stop means is provided which is generally indicated in FIG. 1 and FIG. 3 by numeral 74. This stop means includes a lower member 75, which is adjustably attached to a saddle 76 by means of an adjustment screw 77, and an upper arm 80, which is pivotally connected to the member 75 by means of a clamping screw 79 and is provided with an adjustable stop element 81 at the remote end thereof. The stop element can be located in a predetermined position lengthwise of the slots 49 to engage the leading edge of the envelopes 14 and arrest the movement of said envelopes into the slots 49.

Importantly, the slots 49 which receive the envelopes 14 are contoured in such a way as to ensure that the envelopes are retained in place within said slots and are not moved outwardly under the action of gravitational and centrifugal forces as the envelopes rotate with the wheel assembly. In the preferred embodiment the slots are smoothly curved for the greater part of their length, the curvature having a radius in excess of fifty percent of that of the discs. The end portion of the curve indicated by numeral 50 has a considerably smaller radius of curvature of the order of ten percent that of the disc radius and thereby provides an offset portion of the slot which is adapted to reverse the curvature of the envelopes 14 as they enter the slot. The configuration taken by the envelopes retains them in position because of their tendency to return to their original flat condition and thereby exert pressure against the sides of the slot. In the preferred embodiment the maximum offset is about twice the width of the slot which, in the preferred embodiment, is about ⅞ of an inch.

The envelopes are retained within the slots 49 and turn with the wheel assembly 11 through approximately 270° before being engaged by discharge means mounted adjacent each disc, and indicated in FIG. 1 by numeral 82. The discharge means 82 consists of a plurality of arcuate fingers 83 each extending in cantilever relation from a saddle 84 to which they are adjustably attached as by screw 85. The saddles 84 are slidably mounted to a cross member 86, which is attached at its ends between depending frame brackets 87, and said saddles 84 are provided with clamping screws 88 by which the arcuate elements 83 can be positioned adjacent associated discs 20, 21 and 22 as shown in FIG. 5. The arcuate elements 83 engage the leading edge of the envelopes 14 and, because of the relative motion of the wheel assembly 11 such engagement urges the envelopes outwardly of the slots 49 and onto the discharge conveyor 16 by which they are carried in a stacked, dry condition to a pick up point at the end of the frame 12.

It will be understood that during the rotation of the wheel assembly 11 the envelopes 14 retained by said assembly are subjected to drying by heated air issuing from the plenum chamber assembly 17 which will now be described.

As shown in FIGS. 1 and 2, the plenum chamber assembly 17 includes first and second sections 90 and 91 which are of arcuate configuration and are embracingly disposed about the wheel assembly 11. The sections 90 and 91 are movably mounted to the frame 12 so that they may be moved laterally to a location relative to the disc 20 which will ensure the most efficient distribution of drying air onto the flap end of the envelopes projecting beyond said disc. Heated air is introduced into the plenum chamber sections 90 and 91 by individual blowers 92 and 93 respectively, which are disposed in the lower end of each section. In order to provide for the aforementioned lateral movement of said sections the upper end of each section includes spaced loops 94 welded, or otherwise attached thereto, which are disposed in sliding relation about the frame cross members 26. At its lower end, section 90 includes a U-shaped element 95 which is received in embracing relation about a frame cross member 96 and includes a clamping screw 97 by which the location of the section 90 may be fixed. In similar manner, the lower end of section 91 includes a lengthwise slotted T-shaped element 99 which is fixedly attached to the underside of the plenum base plate 98. The slotted T-shaped element 99 receives a fastener 102 threadedly connected to a cross member 101, which extends between vertical frame members 45, and this structural arrangement of parts provides a means by which the section 91 may be fixed in position.

Heated air is distributed to the envelopes by means of a plurality of discharge openings 103 which are provided in the inside faces 104 and 105 respectively of each of the plenum chamber sections 90 and 91. In order to provide maximum distribution of heated air issuing from apertures 103, each of the sections 90 and 91 includes a radially extending skirt portion indicated by numerals 106 and 107 respectively. Each skirt portion 106 and 107 constitutes a wall means and is provided with a transversely extending arcuate portion indicated by numerals 108 and 109 respectively and, as clearly shown by FIGS. 2 and 5, this structural arrangement of parts, in effect defines arcuate drying ducts through which the envelopes pass during the drying process. For example, in the case of plenum section 90, the duct is defined by the outer face of the disc 20; the apertured curved face 104; the skirt portion 106 and the arcuate portion 108.

Figure 4:
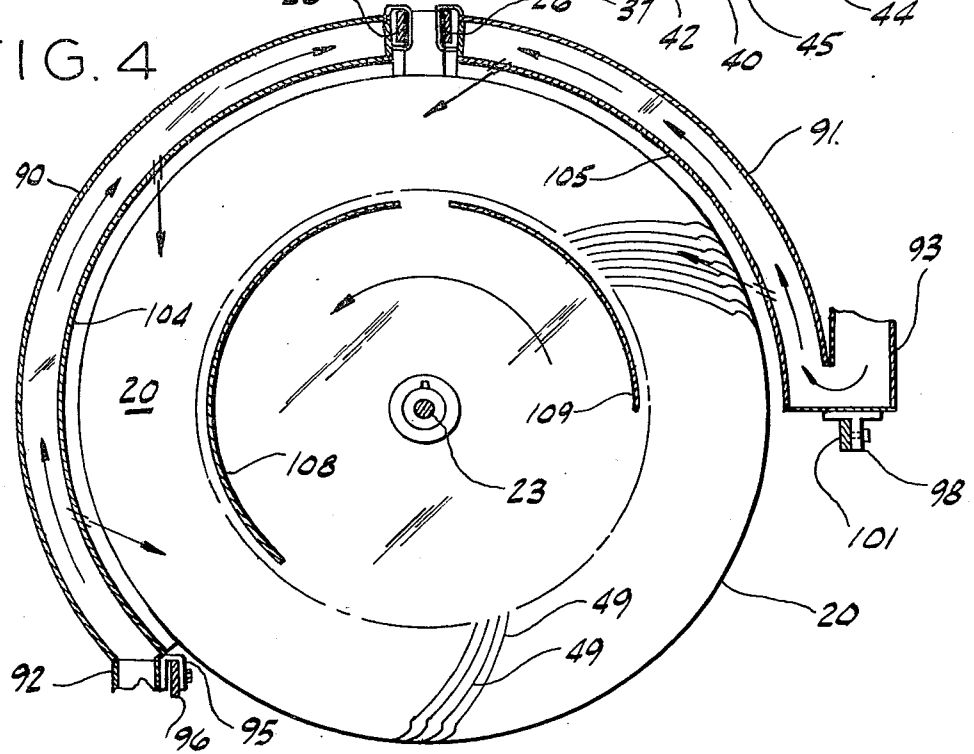
FIG. 4 is a fragmentary cross sectional view taken on line 4—4 of FIG. 2.

Importantly, and as will be understood by reference to FIGS. 4 and 8 the apertures 103, provided in the plenum sections 90 and 91, are formed in such a way as to direct the heated air non-radially into the wheel assembly 11. In this way the heated air is evenly and more efficiently distributed between the envelopes. The preferred attitude of the apertures 103 is shown in FIG. 4, which is somewhat schematic in nature and illustrates the direction of flow from selected apertures in each section to illustrate the inclination of the airstream relative to the disposition of the slots 49 when read in conjunction with FIG. 8 inclining it to the desired angle.

The slots 49 are of a width to accommodate most common sizes of envelopes. However, the slots are also adapted to receive relatively thin sheet material and relatively slick sheet material as will be best understood by reference to FIG. 8 which shows that each slot includes an associated washer element indicated by numeral 110 and an associated spring finger element 111. Under normal conditions the disposition of these elements 110 and 111 is as shown by the elements disposed adjacent slot 49'. When the material to be received is relatively thin, the washer 110, which is provided with a comparatively large hole, is moved into an overlap position with the slot as shown by the washer disposed adjacent slot 49'' and the fastener 112, by which it is attached to the disc, is tightened to clamp said washer in this position, thereby effectively narrowing the width of the slot 49'' at this point. When the material to be received is relatively slick, the spring finger 111 is rotated in a counterclockwise direction and the fastener 113, by which it is attached to the disc, is tightened to clamp said spring finger into a position in which it exerts a pressure against the material.

It is thought that the structural relationship of parts and the functional advantages of this drying apparatus have become fully apparent from the foregoing description of parts. However, for completeness of disclosure the operation of the apparatus will be briefly described.

As shown by reference to FIGS. 1, 5 and 7 the envelopes 14 are inserted between the upper and lower belts 33 and 34 in such a manner that their rear end is gripped between the adjacent spans of the upper and lower belts 33 and 34 causing said envelopes to be carried toward the drying wheel assembly 11. As shown by reference to FIGS. 3 and 6 the envelopes are rotated by the guide assembly 15 from the horizontal plane to the vertical plane by a relatively large diameter belt wheel 43 around which adjacent belt spans 33' and 34' turn. Radiused guide fingers 51, 52 and 53 cooperate with belt wheel 43 and guide wheel 56 to turn the envelopes into the vertical position. As the envelopes emerge from between the belt spans 33' and 34' they are gripped adjacent the flap end and adjacent the rear end by spaced friction wheels 57 and 59 aligned with drive wheel 58 and the outer face of the upper belt 33 respectively. As shown in FIG. 6 the slots 49 of the wheel assembly 11 rotate in synchronized relation with the delivery of the envelopes to the point at which they are engaged by said friction wheels so that each envelope is fed into an associated slot as it passes this point. The circumferential speed of the wheel assembly 11 is considerably slower than the delivery speed of the envelopes and, in the preferred embodiment, the angular velocity of the wheel assembly 11 and the linear belt velocity are accurately synchronized by using the same motor 30 to drive the wheel assembly shaft 23 and the belt drive shaft 40. In order to ensure that the envelopes 14 are maintained in an aligned path into the slots 49, one or more hook guides 70 can be provided clamped to a cross-member 69. Preferably, such hook guides are less than one inch in width, and are disposed in aligned relation with the discs; and when only one such guide is used it is aligned with disc 20. Pressure applied by pressure wheels 60 and 61 ensures that the envelopes 14 conform substantially with the contour of the guide fingers 51, 52 and 53, said wheels having a slightly larger diameter than the wheel 58. The extent to which the envelopes are received within slot 49 is determined by an adjustable stop means 74 which is positioned so that the envelopes 14 of the size indicated project radially outwardly of the slots 49. The envelopes are secured against the tendency for centrifugal force to move them outwardly by the configuration of the slots 49 which are contoured to include an offset retaining portion 50 at the outer opening end.

The envelopes rotate with the wheel assembly 11 until removed therefrom by the discharge means which provides arcuate fingers adjacent each of the discs. During their passage around the wheel the envelopes 14 are subjected to drying air from the plenum chamber assembly 17; and the two sections 90 and 91 of this assembly are transversely adjustable relative to the outer disc 20 and cooperate with said disc to define arcuate heating ducts. These ducts are charged with heating air directed generally inwardly of the wheel assembly 11 by apertures 103 which are configurated to direct drying air in a non-radial direction relative to the wheel assembly 11 so that, as shown in FIG. 6, the air tends to be directed between the envelopes to further facilitate the circulation of drying air of the gummed surface.

It will be understood that pressure from the inwardly directed air also tends to act in opposition to centrifugal forces tending to urge the envelopes outwardly of the slots.

It will be understood that one of more of the discs 20, 21 and 22 can be adjusted lengthwise of the shaft 23 to accommodate a different size. It has been determined that a disc of 72 inches in diameter operating at an angular velocity of two revolutions per minute will easily handle approximately 12,000 envelopes per hour. The provision of auxiliary holding means adjacent the slots permits material other than envelopes to be readily gripped even though it is of a lesser thickness and has a slicker surface than the more common envelope with which the apparatus is primarily used.

I claim as my invention:

1. In an apparatus for drying pre-gummed envelopes:

(a) support means, (b) shaft means rotatively mounted to the support means, (c) drive means continuously rotating the shaft means, (d) drying wheel means including at least two rigid discs mounted on said shaft means each disc including a plurality of outwardly extending curved slots formed therein, open-ended at the circumference of said disc to receive the envelopes the slots defining a generally smooth curve having a discontinuous portion closer to the open end than the closed end to provide pressure means to retain the envelopes against outward movement, and (e) drying means supplying drying air to said gummed envelopes.

2. In an apparatus for drying pre-gummed envelopes:

(a) support means, (b) shaft means rotatively mounted to the support means, (c) drive means continuously rotating the shaft means, (d) drying wheel means including at least two rigid discs mounted on said shaft means each disc including a plurality of outwardly extending curved slots formed therein, open-ended at the circumference of said disc to receive the envelopes the slots including an associated pressure means to retain the envelopes against outward movement, (e) drying means supplying drying air to said gummed envelopes, (f) adjustable stop means including a positive stop member operatively carried by the support means and disposed adjacent at least one of said discs, said stop member extending across said envelope receiving slots in engageable relation with said envelopes and being adjustable lengthwise of said slots to selectively predetermine the extent to which said envelopes are initially received within said slots upon entry therein, and (g) discharge means for urging said envelopes outwardly of said slots.

* * * * *

UNITED STATES PATENT OFFICE

CERTIFICATE OF CORRECTION

Patent No. 4,126,948 Dated November 28, 1978

Inventor(s) Hubert R. VerMehren

It is certified that error appears in the above-identified patent and that said Letters Patent are hereby corrected as shown below:

Column 5:

Line 6, delete "7/8", insert --1/8--.

Signed and Sealed this

First Day of May 1979

[SEAL]

Attest:

RUTH C. MASON
Attesting Officer

DONALD W. BANNER
Commissioner of Patents and Trademarks